United States Patent [19]

Bernet

[11] Patent Number: 4,651,548

[45] Date of Patent: Mar. 24, 1987

[54] WOBBLE-DIE FORGING MACHINE

[75] Inventor: Alois Bernet, Jona, Switzerland

[73] Assignee: Heinrich Schmid Maschinenund Werkzeugbau AG, Rapperswil, Switzerland

[21] Appl. No.: 796,631

[22] Filed: Nov. 8, 1985

[30] Foreign Application Priority Data

Nov. 27, 1984 [CH] Switzerland ..... 650/84

[51] Int. Cl.[4] ..... B21J 9/04

[52] U.S. Cl. ..... 72/71; 72/67

[58] Field of Search ..... 72/70, 71, 84, 67; 29/168

[56] References Cited

U.S. PATENT DOCUMENTS

| | | | |
|---|---|---|---|
| 1,003,849 | 9/1911 | Worth | 72/71 |
| 3,461,701 | 8/1969 | Marcovitch | 72/84 |
| 3,798,944 | 3/1974 | Foster et al. | 72/67 |

FOREIGN PATENT DOCUMENTS

| | | | |
|---|---|---|---|
| 721169 | 3/1980 | U.S.S.R. | 72/71 |

*Primary Examiner*—Lowell A. Larson

*Attorney, Agent, or Firm*—Karl F. Ross; Herbert Dubno

[57] ABSTRACT

The ejector, penetrating the lower die of the wobble die forging machine, bears a punch vertically displaceable to the former, which interacts with a cutter arranged centrically and rigidly in the upper die to penetrate the workpiece and thrust the thereby resulting excess material into the cutter under the effect of a superimposed movement of stroke of the ejector piston, the movement of stroke of the piston bearing the lower die, and the wobble movement of the upper die. In this way, highly precise through bore in respect of diameter and rotation can be reached, whereby, in addition to this, a concentration of material can be achieved in the hitherto always soft core of the workpiece, which comes nearer to that in the formed edge regions of the workpiece, with which a wall of a hole of finest finish and very high strength results.

6 Claims, 4 Drawing Figures

FIG. 3
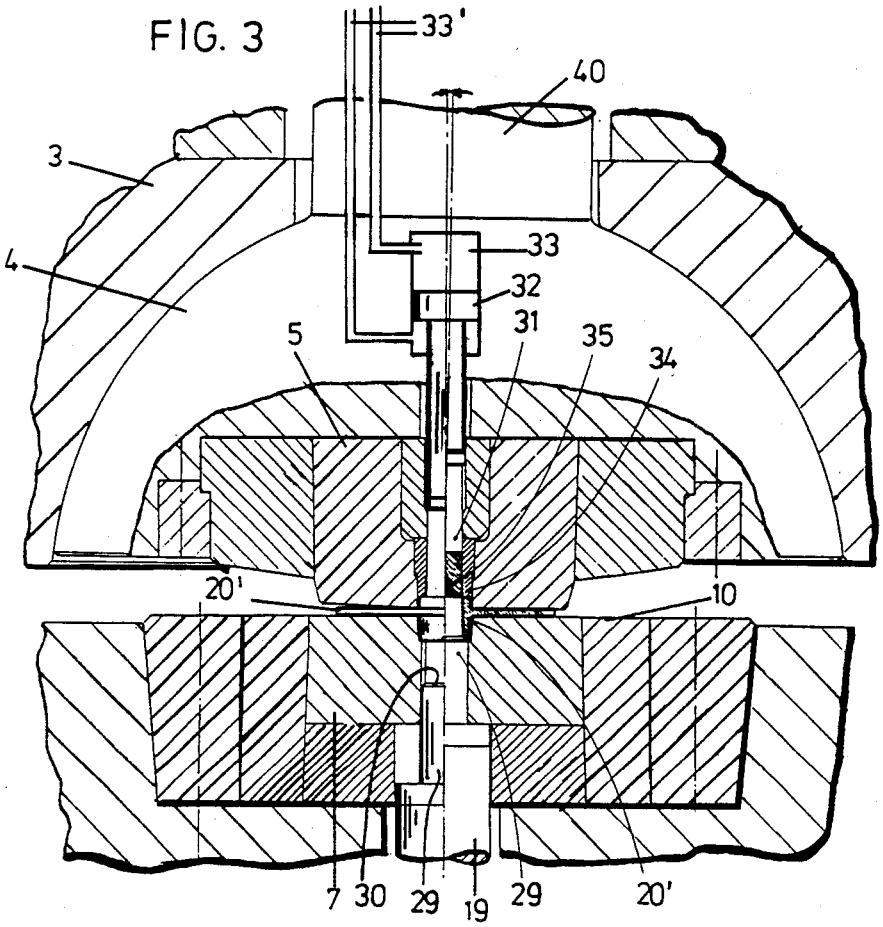
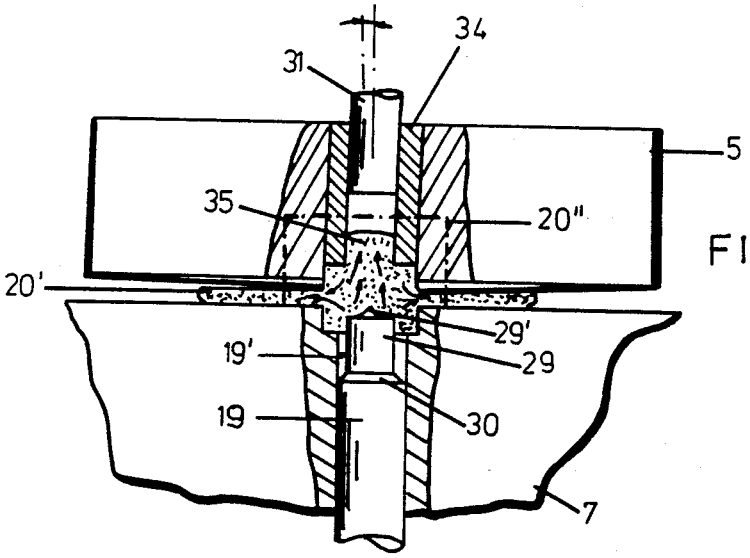
FIG. 4

WOBBLE-DIE FORGING MACHINE

CROSS REFERENCE TO RELATED APPLICATION

This application is related to Ser. No. 715,912 filed Mar. 22, 1985.

FIELD OF THE INVENTION

My present invention relates to a wobble-die forging machine, the upper die of which is built into a bell-shaped mounting supported in a spheroidal pan at the machine frame, and on the upper guide spigot of said bell-shaped mounting, means engage for the generation of wobble movements on the upper die; and the lower die of which is supported at the machine frame and displaceable vertically upwardly against the upper die by a hydraulic piston-cylinder pressure system to deform a blank between the upper and lower die, whereby a vertically displaceable ejector for the finished workpiece is found centrically within the pressure piston of the piston-cylinder system, said ejector being under the effect of its own piston-cylinder pressure system.

BACKGROUND OF THE INVENTION

Compared with the extrusion molding, in which the deformation force acts simultaneously on the entire workpiece surface, in the case of wobble-die forging, force is as known exerted only on a partial surface, whereby only small friction can arise and the material flows in radial direction without great resistance. For this, the blank is deformed between an upper die and a lower die with a circularly rocking movement of the upper die, so that the effective deformation force is concentrated on only a partial surface of the workpiece. The deformation is effected by movement of the pressure zone over the entire workpiece surface.

Due to the smaller contact area and the more favorable friction conditions, the deformation force in wobble-die forging machines is thus substantially smaller than in the case of conventional extrusion molding.

Resulting from this are the advantages of appreciably smaller machines, smaller die loading and smaller noise development. In addition, significantly larger changes in shape can be attained in one operating step by the wobble-die forging machines in comparison with the multistage dies, necessary for this in conventional extrusion molding, with all their costs and setting-up times.

This wobble-die forging has become increasingly significant, particularly since the required technologies has developed to the extent that functionally capable machines of the afore-named kind are available.

An essential problem remained hitherto unsolved, however, namely, the possibility of the manufacture of precise through bores in the workpiece during its deformation.

OBJECT OF THE INVENTION

The object of my present invention is to provide a wobble-die forging machine of the afore-named kind in such a manner that a workpiece, in particular a body of rotation, such as a flange with hub or the like can be manufactured with a central through bore by the deformation process, and with such precision that a refinishing operation can be dispensed with.

SUMMARY OF THE INVENTION

I realize this object, in accordance with my present invention, that the ejector penetrating the lower die bears a punch vertically displaceable relative to the former, which interacts with a cutter arranged centrally and rigidly in the upper die to penetrate the workpiece and thrust the thereby resulting excess material into the cutter under the effect of the superimposed movements of the stroke of the ejector piston, of the stroke of the piston bearing the lower die, and of the wobble of the upper die.

Tests have shown that in this way and without any finishing process, highly precise through bores in respect of diameter and rotation can be reached, whereby, in addition to this, a concentration of material can be achieved in the hitherto always soft core of the workpiece, which comes nearer to that in the formed edge regions of the workpiece, with which a wall of the hole of finest finish and very high strength results.

In a further development of the present invention, a further, vertically displaceable ejector for the excess material thrust back into the cutter is arranged centrically in the bell-shaped mounting and is displaced by its own piston-cylinder system.

For an optimal control of the machine during the forming process and for the ensuing removal of the workpiece and excess material, it is of advantage when the piston-cylinder pressure system bearing the lower die as well as the piston-cylinder pressure system actuating the ejector or the punch on the lower die, as well as also the piston-cylinder pressure system actuating the further ejector of the upper die are connected variably controllably to a hydraulic control system. For this, it is, moreover, advantageous when the punch serves, after its release out of the workpiece, as ejector for the workpiece by a repeated actuation of its piston-cylinder pressure system.

Further, the additional development can be such that the punch has a shoulder for pressing a chamfer onto the edge of the hole of the workpiece.

For optimal centering of the blank to begin the wobble process, the punch is used as a centering means at the beginning of the forming process.

BRIEF DESCRIPTION OF THE DRAWING

The above and other features of my invention will now be described in detail with reference to the accompanying drawing in which:

FIG. 3 is a partial vertical section of the wobble-die forging machine according to the invention to a larger scale; and FIG. 4 is a schematic sectional view of the upper die and the lower die on a larger scale for the illustration of the deformation process.

SPECIFIC DESCRIPTION

Figure 1:
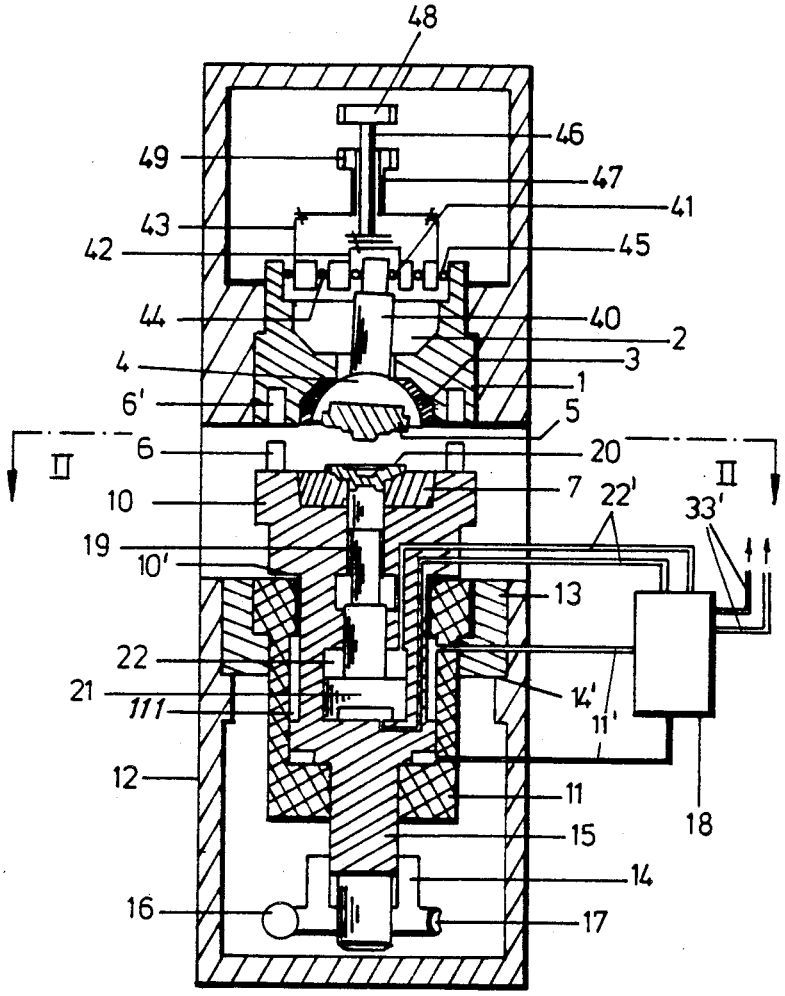
FIG. 1 is a schematic sectional illustration of an overall view of a wobble-die forging machine.
Figure 2:
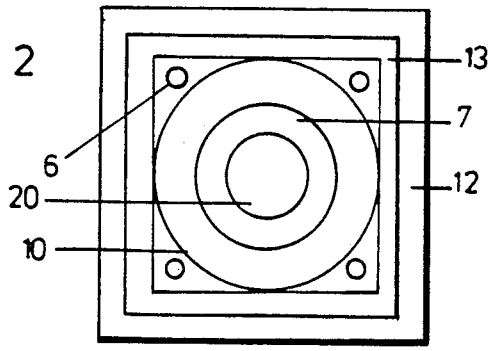
FIG. 2 shows the wobble-die forging machine of FIG. 1, in a top plan view along the line II—II.

The wobble-die forging machine, which is illustrated in FIG. 1 and shown in open position after a deformation process, comprises a lower die 7 as well as an upper die 5, between which a workpiece 20 is deformed with a circularly rocking movement of the upper die 5.

For this, the lower die 7 bears by way of a hydraulic piston-cylinder system 10 and 11 against the machine frame 12 and is displaceable vertically upwards against the upper die 5. The lower die 7 is in that case exchangeably inserted in the end face of the piston 10 of the pressure system, the cylinder 11 of which is surrounded in its upper rim region by a collar 13, which firmly sits on an annular shoulder 14 of the machine frame 12.

Through this arrangement, a possible deflection of the machine frame 12 under load has no influence on the guidance of the piston 10, the precision of which is, consequently, always maintained.

The stroke of the piston 10 in the cylinder 11 is limited on the one hand downwardly by an annular shoulder 10' at the piston 10, which co-operates with the upper end face of the cylinder 11, and on the other hand upwardly by an abutment nut 14, which co-operates with the lower end face of the cylinder 11. For this, the piston 10 extends by a lower spigot 15 in fluid-tight manner through the base of the cylinder 11, on which spigot 15 the abutment nut 14 is threaded to be axially displaceable. The axial displacement of the abutment nut 14 for a stroke change at the pressure piston 10 and thus setting of the work-piece height in that case takes place through a spindle 16, which is actuable by motor or manually and engages in a gear rim 17 at the outer circumference of the abutment nut 14.

For the generation of the pressing force, which is directed vertically upwards and can amount to some thousand kiloNewtons, at the pressure piston 10, the cylinder chamber 111 of the piston 11 of the piston-cylinder pressure system is connected by a pressure line 11' to a hydraulic system 18, which preferably comprises an adjustable high pressure axial-piston pump for the production of the pressing force and low-pressure and high-pressure pump means for a rapid setting of the pressure piston (not shown).

As FIG. 1 furthermore illustrates, arranged centrally within the pressure piston 10 is a vertically displaceable ejector 19, which is suitable to press the workpiece 20 after its production out of the lower die 7. For this, the ejector 19 in its lower part forms a piston 21, the cylinder chamber 22 of which is formed in the pressure piston 10 and connected through appropriate pressure ducts 22' to the hydraulic systems 18.

Furthermore, the pressure piston 10 on its upper end face carries a plurality of guide columns 6, which project vertically upwards and during the stroke movement of the pressure piston 10 enter into corresponding bores 6' at the lower end face of an upper part 1 of the machine, which part is firmly connected with the machine frame 12, and thus assure an optimum alignment of upper and lower dies 5 and 7.

At this upper part 1 of the wobble-die forging machine, a bell-shaped mounting 4, which exchangeably carries the upper die 5, is supported in a spheroidal pan 3 in such a manner that the circularly rocking movements described in the preceding can be imparted to the upper die 5 through a corresponding displacement of the bell-shaped mounting in the spheroidal pan.

For this, a guide spigot 40, which can execute a pendulating movement within a free space 2 of the upper part 1 of the machine, projects vertically upwards and centrally from the bell-shaped mounting 4. For the generation of the aforementioned movements, the free end of the guide spigot 40 engages through suitable self-aligning roller bearing means 41 into a first eccentric sleeve 42, which is rotationally guided by way of bearing means 44 in a second eccentric sleeve 43 rotationally supported by way of bearing means 45 at the upper part 1 of the machine.

In order to be able to drive both these eccentric sleeves 42 and 43 in the initially described manner, these stand in driving connection here by way of co-axial driving axles 46 and 47 and gear rims 48 and 49 with not more closely shown motor and gear means.

So far, the construction and the manner of function of a wobble-die forging machine can be presupposed as known, so that further explanations are redundant.

In order now to be able to form the central bore during the forming of a blank, for example, in a body of rotation with hub and flange, it is intended according to the invention to superimpose on the latter a punch 29, the ejector 19 penetrating the lower die 7, as illustrated in more detail in FIGS. 3 and 4. This punch 29 interacts with a cutter 34 arranged centrically and rigidly in the upper die 5 to penetrate the workpiece and thrust the thereby resulting excess material 35 into the cutter 34 under the effect of a superimposed movement of stroke of the ejector piston 21, the movement of stroke of the piston 10 bearing the lower die 7, and the wobble movement of the upper die 5.

This procedure will be more readily understood from the illustration in FIG. 4. First a blank 20'' is inserted between upper die 5 and lower die 7, whereby the punch 29 is approximately flush with the bearing surface of the lower die 7 for the blank 20'' and there functions as centering means for the blank. For this, the blank 20'' can have a centrical punch mark, into which a center point 29' on the face side of the punch 29 enters. Then, the deformation process starts vertically upwards under the wobbling movement of the upper die 5 and under displacement of the lower die 7, whereby the material of the blank flows into the dies, whereby the blank 29 at first gives way downwardly without resistance. At an appropriate moment, approximately shortly before completion of the end form of the workpiece 20', the punch 29 is then pressed upwardly, whereby, under the wobble movement of the upper die 5, this cuts through the material of the blank or workpiece and thrusts the excess material 35 into the cutter 34. This is possible without difficulty since the edge and flange areas of the almost finished workpiece are already highly compressed and therefore only the softer core material is pushed out and accordingly flows into the cutter 34, whereby a finely finished wall of the hole in the workpiece results. The process is completed when the workpiece 20' is completely pushed through by the punch 29 and the latter has possibly entered somewhat into the cutter 34.

In order to be able to chamfer the bore in the workpiece 20', the punch 29 has a shoulder 30 for pressing a chamfer onto the edge of the hole of the workpiece. Since some material then flows into the annular clearance between the guide bore 19' and the punch 29, this material is thrust back when pressing on the chamfer, which leads to a concentration of the workpiece material in this region.

In order now to bring the workpiece out of the die after its completion, the punch 29 functions as ejector, after its release out of the workpiece, by a repeated actuation of its piston-cylinder pressure system 21, 22.

FIG. 3 in particular shows, moreover, that a further, vertically displaceable ejector 31 for the excess material 35 thrust into the cutter 34 is centrally arranged in the bell-shaped mounting 4. This ejector 31 stands under the effect of its own piston-cylinder pressure system 32, 33, whereby the pressure chamber 33 concerned is likewise connected to the hydraulic control system 18 by way of an appropriate pressure line 33. At the beginning of the deformation process, the face side of this ejector 31 can in the first place be flush with the face side of the cutter 34.

From the afore-described there results, therefore, a wobble-die forging machine with which it is possible to insert a centric bore in the workpiece during the forming process, whereby, still influenced through appropriate development of the punch, a wall of the hole of finest finish and strength as well as precise diameter and best exactitude of rotation results.

What I claim is:

1. A wobble-die forging machine, comprising:

a machine frame;

a spheroidal pan on an upper portion of said machine frame forming a bell-shaped mounting;

an upper die received in said bell-shaped mounted so as to execute a wobble motion therein, said upper die having an upwardly extending projection;

a drive coupled to said upwardly extending projection for generating said wobble motion of said upper die;

a lower die guided for vertical movement on a lower portion of said frame and juxtaposed with said upper die;

a hydraulic piston-cylinder pressure system having a pressure piston acting upon said lower die for pressing a blank between said dies, whereby said wobble motion deforms said blank into said dies;

a vertically displaceable ejector disposed centrally in said piston and axially displaceable therein for ejecting said blank upon deformation from said lower die, said ejector being displaced under the control of a further piston-cylinder system;

a punch formed on said ejector and constructed to penetrate through said blank upon the deformation thereof with upward displacement of said ejector during deformation of said blank to form a through-bore in said blank; and a cutter fixedly positioned centrally in said upper die ad cooperating with said punch to separate excess material in the formation of said through-bore from said blank by forcing said excess material into said cutter.

2. The wobble-die forging machine defined in claim 1, further comprising another vertically displaceable ejector disposed centrally in said mounting and shiftable to force excess material in said cutter out of the latter, and a hydraulic piston-cylinder system connected to said other ejector for displacing same.

3. The wobble-die forging machine defined in claim 2 wherein said systems are connected variably controllably to a hydraulic control system.

4. The wobble-die forging machine defined in claim 1 wherein said punch is formed with a beveled holder for pressing a chamfer in an edge of said through hole.

5. The wobble-die forging machine defined in claim 1 wherein said punch is constructed and arranged, upon withdrawal of said blank to displace said blank out of said lower die with repeated actuation of said further piston-cylinder system.

6. The wobble-die forging machine defined in claim 1 wherein said punch is formed with a centering point adapted to center said blank on said lower die.

* * * * *